US011591137B2

(12) United States Patent
Filleul et al.

(10) Patent No.: US 11,591,137 B2
(45) Date of Patent: Feb. 28, 2023

(54) CHILD RESISTANT CONTAINER

(71) Applicant: Philip Morris Products S.A., Neuchatel (CH)

(72) Inventors: Bayden Filleul, Bray (IE); Michael Nolan, Bray (IE)

(73) Assignee: Philip Morris Products S.A., Neuchatel (CH)

( * ) Notice: Subject to any disclaimer, the term of this patent is extended or adjusted under 35 U.S.C. 154(b) by 93 days.

(21) Appl. No.: 16/772,208

(22) PCT Filed: Dec. 12, 2018

(86) PCT No.: PCT/EP2018/084635
§ 371 (c)(1),
(2) Date: Jun. 12, 2020

(87) PCT Pub. No.: WO2019/115649
PCT Pub. Date: Jun. 20, 2019

(65) Prior Publication Data

US 2021/0070501 A1 Mar. 11, 2021

(30) Foreign Application Priority Data

Dec. 14, 2017 (EP) ..... 17207376

(51) Int. Cl.
*B65D 25/10* (2006.01)
*B65D 50/00* (2006.01)
(Continued)

(52) U.S. Cl.
CPC ..... *B65D 25/101* (2013.01); *B65D 50/00* (2013.01); *B65D 77/048* (2013.01); *B65D 83/00* (2013.01); *B65D 2215/00* (2013.01)

(58) Field of Classification Search
CPC .. B65D 25/005; B65D 25/101; B65D 50/067; B65D 83/049; B65D 77/0486;
(Continued)

(56) References Cited

U.S. PATENT DOCUMENTS 1,955,559 A 4/1934 Narrow
2,957,503 A * 10/1960 Stifter ..... B65D 83/049 141/381
(Continued)

FOREIGN PATENT DOCUMENTS

CN 1524052 A 8/2004
DE 1 934 557 3/1966
(Continued)

OTHER PUBLICATIONS

Russian Office Action and Search Report dated Oct. 25, 2021 in Russian Patent Application No. 2020121808/11(037409) (with English language translation), 19 pages.
(Continued)

*Primary Examiner* — Allan D Stevens
(74) *Attorney, Agent, or Firm* — Oblon, McClelland, Maier & Neustadt, L.L.P.

(57) ABSTRACT

A container is provided, including a tubular body having an open first end and a second end defining a receptacle to receive an elongate storage unit; and a retaining frame within the receptacle to receive and retain the unit, movable between a first configuration to engage a retaining surface of the unit to retain it within the receptacle, and a second configuration in which it is released from engagement with the frame for removal from the container, the frame including a supporting rim circumscribing the first end; and a flexible tab depending from the rim and projecting radially into the receptacle, such that in the first configuration a distal end of the tab is configured to engage the retaining surface,
(Continued)

and when the frame is moved from the first to the second configuration, the tab is bent towards a peripheral wall of the body and away from the retaining surface.

3 Claims, 4 Drawing Sheets

(51) Int. Cl.
*B65D 77/04* (2006.01)
*B65D 83/00* (2006.01)

(58) Field of Classification Search
CPC ..... Y10T 292/438; Y10T 292/0894; Y10T 292/0895; Y10T 292/09; E05B 65/0014
USPC ..... 141/321; 206/249, 1.5, 536, 338–347
See application file for complete search history.

(56) References Cited

U.S. PATENT DOCUMENTS 3,004,566 A * 10/1961 Raimo ..... B65D 83/049 222/424.5
3,042,257 A 7/1962 Dailey
3,067,787 A * 12/1962 Salk ..... B65D 55/02 222/490
3,182,694 A * 5/1965 Raimo ..... B65D 83/049 222/490
3,206,067 A * 9/1965 Smith, Jr. ..... A63B 55/20 221/281
3,409,172 A * 11/1968 Fuglsang-Madsen .... F23Q 2/48 221/229
3,480,182 A * 11/1969 Rigor ..... B65D 83/049 141/321
3,620,413 A * 11/1971 Borsum ..... B65D 83/049 221/256
3,622,041 A * 11/1971 Borsum ..... B65D 51/24 221/202
3,637,109 A * 1/1972 Stiffer ..... B65D 41/26 221/310
4,176,670 A * 12/1979 Repetti ..... G07D 1/00 453/18
4,889,260 A 12/1989 Zeller
5,261,208 A * 11/1993 Lockhart ..... A47F 1/12 206/427
5,347,078 A * 9/1994 Eckels ..... A61M 5/3213 588/249.5
5,564,565 A * 10/1996 Yamada ..... A61M 5/3213 128/919
5,718,689 A * 2/1998 Stevenson ..... A61M 5/3205 128/919
6,511,461 B2 * 1/2003 Jonsson ..... A61M 1/3627 604/110
2006/0032769 A1 * 2/2006 Erickson ..... A61M 5/002 604/110
2010/0258472 A1 10/2010 Okulla et al.
2014/0027332 A1 1/2014 Pawlowski et al.
2015/0108034 A1 4/2015 Deutschle et al.

FOREIGN PATENT DOCUMENTS

DE 38 04 595 A1 8/1989
EP 1 236 651 A1 9/2002
GB 460 460 A 1/1937
GB 2449450 A * 11/2008 ..... B65D 1/32
JP 2000-177743 A 6/2000
JP 2017-503501 A 2/2017
WO WO-2013088178 A1 * 6/2013 ..... A61M 5/002
WO WO 2017/029149 A1 2/2017
WO WO-2019106188 A1 * 6/2019

OTHER PUBLICATIONS

Combined Chinese Office Action and Search Report dated Oct. 8, 2021 in Chinese Patent Application No. 201880075316.3 (with English translation), 11 pages.
International Search Report and Written Opinion dated Mar. 1, 2019 in PCT/EP2018/084635 filed on Dec. 12, 2018.
Notice of Reasons for Rejection dated Nov. 7, 2022 in Japanese Patent Application No. 2020-527879 filed on Dec. 12, 2018, with translation, total 4 pages).

* cited by examiner

CHILD RESISTANT CONTAINER

The present invention relates to a novel container, which finds particular application as a container for consumer goods, such as storage units (e.g. cartridges) for aerosol-generating articles.

It is known to package aerosol-generating articles and other consumer goods in containers formed from folded laminar blanks. Consumer goods are commonly sold in containers having a box for housing the consumer goods and a lid connected to the box about a hinge line extending across a wall of the container. Such packs are typically constructed from laminar cardboard blanks. The lid may take the form of a simple lid flap or a three dimensional cup-shaped hinge lid. In use, the lid is pivoted about the hinge line to open the pack and expose an access opening in the box, through which the consumer can gain access to the consumer goods held within the box. Typical examples of known packages include traditional cigarette packs.

However, with known hinge lid containers such as cigarette packs, the consumer goods stored within the containers may be able to move around within the containers. This is especially true if the container is not completely full. This can be undesirable since the movement may damage the consumer goods. Also, the movement may make the consumer goods harder to access and remove from the container; for example, the consumer goods may have a tendency to move towards the bottom of the container where they are least accessible to the consumer. Additionally, in some instances, it may be desirable for the consumer goods to be stored in a predetermined order. This is difficult to achieve if the consumer goods are able to move about within the container. It would be desirable to provide a container for consumer products which overcomes these deficiencies associated with movement of consumer products within typical containers.

Additionally, in many instances it is desirable for containers for consumer products to be configured to prevent children from accessing the consumer goods contained within the container. This may be to reduce the risk of children accessing certain types of consumer goods. In some cases, the provision of such a child-resistant design may be required by local regulations. For example, many jurisdictions prescribe that child-resistant packaging be used for prescription drugs, over-the-counter medications, refill containers that can contain nicotine, household chemicals, etc. However, typical known packages for consumer goods are not necessarily child-resistant. It would therefore also be desirable to provide a container for consumer goods which prevents children from accessing the consumer goods contained within.

It is therefore an object of the present invention to provide an improved container for consumer goods which overcomes the disadvantages associated with consumer products moving around within the container and which reduces the risk of a child accessing consumer products received within the container.

It is also an object of the present invention to provide a container wherein a consumer product can conveniently be removed in a child-safe manner.

According to a first aspect of the present invention, there is provided a container comprising a tubular body having an open first end and a second end to define a receptacle for receiving at least one elongate storage unit; and a retaining frame arranged within the receptacle and adapted to receive and retain the at least one storage unit, wherein the retaining frame is movable between a first configuration, wherein the retaining frame is adapted to engage a retaining surface of the at least one storage unit to retain the at least one storage unit within the receptacle, and a second configuration, wherein the at least one storage unit is released from engagement with the retaining frame to be removed from the container. Further, the retaining frame comprises a supporting rim and at least one flexible tab depending from the supporting rim and projecting radially into the receptacle such that in the first configuration a distal end of the tab is adapted to engage the retaining surface of the at least one storage unit; and wherein, when the retaining frame is moved from the first configuration to the second configuration, the at least one tab is bent towards a peripheral wall of the tubular body and away from the retaining surface of the at least one storage unit.

In operation, at least one elongate storage unit is held within the tubular body. The at least one elongate storage unit is held in place by the retaining frame when the retaining frame is in the first configuration. In the first configuration, the retaining frame engages a retaining surface of the at least one storage unit to retain the storage unit within the receptacle. When the user wishes to remove the at least one storage unit from the receptacle, the retaining frame is moved such that the at least one storage unit is released from engagement with the retaining frame. This allows the at least one storage unit to be removed from the container.

This provision advantageously provides a child-resistant means for storing at least one elongate storage unit which still allows the at least one storage unit to be readily removed by a consumer. Additionally, the provision of the retaining frame engaging directly with the at least one storage unit in the first configuration advantageously holds the at least one elongate storage unit in place and prevents the at least one elongate storage unit from moving within the container preventing damage to the at least one elongate storage unit and allowing it to be readily accessed by the consumer when desired.

As used herein, the term "child-resistant" refers to a system which is designed to prevent children from removing certain consumer goods, such as elongate storage units, from a container.

The receptacle may be sized to accommodate any number of elongate storage units. Where the receptacle is sized to accommodate multiple elongate storage units, only the elongate storage unit nearest the open first end is retained directly by the retaining frame. The at least one elongate storage unit may be for holding a liquid or a powder.

As used herein, the term "tubular" refers to an elongate hollow body. The tubular body may have any cross-sectional shape. For example, the tubular body may have a circular, square, or oblong cross sectional shape. The elongate hollow body may have a cross sectional shape which conforms to the cross sectional shape of the at least one elongate storage unit. This is advantageous where the receptacle is designed to retain multiple elongate storage units, since this allows them to be arranged substantially in axial alignment within the receptacle. This prevents movement of the multiple elongate storage units and allows them to be retained in a pre-determined order within the container.

The tubular body may be formed from a folded blank. The tubular body may be formed from cardboard, paperboard, plastic, metal or combinations thereof.

The tubular body may include at least one opening small enough to prevent the at least one elongate storage unit from passing though the at least one opening.

The provision of the at least one opening may advantageously save weight and material. Moreover, it may allow the consumer to see into the tubular body so they can determine how many of the elongate storage units are left in the container.

The retaining frame may be movable between the first configuration and the second configuration by any means. For example, the retaining frame may be movable between the first configuration and the second configuration by hand. The retaining frame may be movable between the first configuration and the second configuration by means of an external tool such as an elongate holder designed to receive the at least one storage unit. For example, an elongate tubular holder having an external diameter such that it can pass through the open first end of the tubular body and an end cavity sized to receive at least one elongate storage unit may be inserted into the open first end of the tubular body, cavity end first, while the retaining frame is in the first configuration. The action of inserting the holder into the open first end of the tubular body may cause the retaining frame to move to the second configuration, thereby releasing the at least one elongate storage unit. The at least one elongate storage unit may engage with the inner surface of the end cavity of the holder and the holder may be removed, with the at least one elongate storage unit disposed within the cavity.

Containers according to the present invention find particular application as packs for components for use with aerosol-generating articles.

The retaining frame may comprise a substantially elastically deformable material which allows the retaining frame to move between the first and the second configuration.

This advantageously provides a simple means by which the retaining frame may move between the two configurations without the need for complex moving parts. The elastically deformable material may be biased towards the first configuration such that an external force is required to move the retaining frame from the first configuration into the second configuration. In the absence of this force, the retaining frame will adopt the first configuration.

The retaining frame may be formed from cardboard, metal, or plastic. Without wishing to be bound by theory, it is expected that these materials can be configured to have flexibility values which can ensure proper operation of the container.

As described briefly above, the retaining frame comprises a supporting rim and at least one flexible tab depending from the supporting rim and projecting radially into the receptacle such that in the first configuration a distal end of the tab is adapted to engage the retaining surface of the at least one storage unit; and wherein, when the retaining frame is moved from the first configuration to the second configuration, the at least one tab is bent towards a peripheral wall of the tubular body and away from the retaining surface of the at least one storage unit.

In the first configuration, the at least one flexible tab advantageously exerts a force on the retaining surface of the at least one storage unit to hold the at least one storage unit in place.

The retaining frame may comprise a plurality of flexible tabs depending from the supporting rim and projecting radially into the receptacle, the plurality of flexible tabs being equally spaced about the peripheral wall of the tubular body.

The provision of a plurality of flexible tabs may advantageously allow the at least one storage unit to be gripped from all sides so as to more effectively retain the at least one storage unit.

The retaining frame may comprise any number of flexible tabs. For example, the retaining frame may comprise 2, 3, 4, or 5 flexible tabs. Where the retaining frame comprises an even number of flexible tabs, each flexible tab will be disposed substantially opposite another flexible tab. Without wishing to be bound by theory, this may advantageously mean that each flexible tab exerts a force which is directly opposed by another flexible tab effectively retaining the at least one storage unit.

The container may further comprise a lid hinged to the first end of the tubular body and movable between a closed position, wherein the lid occludes the first end of the tubular body, and an open position wherein the lid is pivoted to reveal the open first end of the tubular body.

The provision of a lid advantageously provides an additional means for preventing children from accessing and removing the at least one elongate storage unit, from the container. The lid may also advantageously prevent the ingress of material which may contaminate the receptacle and the at least one elongate storage unit.

The lid may be integrally formed with the tubular body. In this case, the lid may be hingedly joined to the tubular body by a living hinge.

The container may further comprise a means for securing the lid in the closed position. This may be achieved by providing a protrusion on the lid which engages with a corresponding recess on the inner surface of the tubular body when the lid is in the closed position. Alternatively, or in addition, the lid may be sized such that, in the closed position, it forms an interference fit with the inner surface of the tubular body.

In operation, the user would need to put the lid into the open position before removing the at least one storage unit.

The second end of the tubular body may be closed.

In this case, the at least one storage unit can only be inserted or removed from the container through the open first end. Where the second end of the tubular body is closed, the container may be designed to accommodate only one storage unit.

The second end of the tubular body may be open, and the at least one elongate storage unit may enter the container though the open second end.

Where the second end of the tubular body is open, the container may be designed to accommodate more than one elongate storage unit. In this case, the elongate storage units may be inserted into the container through the open second end and removed from the container through the open first end. As an elongate storage unit is inserted into the second end, this may push the elongate storage units which are already in the container towards the first end. Advantageously, this allows the container to be refilled while maintaining the order of elongate storage units. It also advantageously allows the container to be refilled with elongate storage units while ensuring that the elongate storage units which have been in the container longer, are used first.

Furthermore, this provision advantageously allows the container to store both used and unused elongate storage units. An unused elongate storage unit may be removed from the first end of the tubular body as described above. Once it has been used, it may be inserted into the open second end of the tubular body. This may push the elongate storage units which are already in the container towards the open first end.

The container may further comprise a means for preventing the removal of the at least one elongate storage unit from the open second end of the tube. This advantageously ensures that the order of the elongate storage units is maintained and may help prevent the user from accidentally reusing an already used elongate storage unit. This also advantageously ensures the container is child resistant.

The container may comprise a lid hinged to the second end of the tubular body and movable between a closed position, wherein the lid occludes the second end of the tubular body, and an open position, in which the lid is pivoted to reveal the open second end of the tubular body.

In a second aspect of the present invention, there is provided a container array comprising a first container and a second container, wherein both the first container and the second container include tubular bodies in which the second ends are closed. The closed second end of the tubular body of the first container is connected to the closed second end of the tubular body of the second container such that the first and second containers are substantially aligned.

This advantageously allows the container array to conveniently store multiple elongate storage units separately. This may allow each storage unit to be kept sealed before use.

In a third aspect of the present invention, there is provided a container array comprising a plurality of containers arranged next to each other and connected to each other along their tubular bodies.

The container array of the third aspect of the present invention may comprise containers having tubular bodies with second ends which are open, closed, or a combination of the two. The provision of an array having a plurality of containers arranged next to each other advantageously allows multiple different elongate storage units to be available at the same time, giving the consumer the option to choose which storage unit they want.

The container array of either the second or third aspects of the present invention may further comprise an outer housing surrounding the containers.

The outer housing may be formed from any material. For example, the outer housing may comprise plastic, cardboard, or combinations thereof. The outer housing may be formed from a folded laminar blank.

The provision of an outer housing advantageously further prevents children from accessing the at least one elongate storage unit, making the array child-resistant. The outer housing may also protect the plurality of containers from damage.

In either of the container arrays according to the second and third aspects of the present invention, the individual containers of the container array may be separated by a user. For example, adjacent containers may be connected to one another along a line of weakness which a user may break in order to separate the containers. The line of weakness may comprise a thin piece of material or a perforated piece of material. Alternately, the line of weakness may comprise an adhesive connecting adjacent containers. The provision that individual containers of a container array may be separated by a user advantageously allows the user to carry fewer containers at a time which can save space.

The container arrays according to the second or third aspects of the present invention may further comprise an outer wrapper which covers at least a portion of the outside of the tubular bodies of the containers. The outer wrapper may be formed from a thin film material such a paper, metal foil, or a polymeric film. The outer wrapper may display product information. Where the container array includes an outer housing, the outer wrapper may be sized to fit into the outer housing along with the plurality of containers.

Where the individual containers of the container array are separable, the outer wrapper may indicate where the adjacent containers may be separated. For example, the outer wrapper may include a printed indication of the line of weakness. The outer wrapper may cover at least a portion of two adjacent containers such that the outer wrapper is torn when the adjacent containers are separated. In this case, the outer wrapper may include a perforated line overlying the line of weakness between the adjacent containers. This advantageously ensures the outer wrapper tears in a controlled manner forming a clean break. This also advantageously indicates to the user that the containers of the container array may be separated.

In a fourth aspect of the present invention, there is provided a container comprising a tubular body having an open first end and a second end to define a receptacle; at least one elongate storage unit received within the receptacle; and a retaining frame arranged within the receptacle and adapted to receive and retain the at least one storage unit, wherein the retaining frame is movable between a first configuration, wherein the retaining frame is adapted to engage a retaining surface of the at least one storage unit to retain the at least one storage unit within the receptacle, and a second configuration, wherein the at least one storage unit is released from engagement with the retaining frame to be removed from the container; the at least one storage unit comprising a stem portion having a stem diameter and an engagement portion having an engagement diameter greater than the stem diameter, the engagement portion defining the retaining surface of the storage unit.

The retaining frame of the fourth aspect of the invention may comprise a supporting rim and at least one flexible tab depending from the supporting rim and projecting radially into the receptacle such that in the first configuration a distal end of the tab is adapted to engage the retaining surface of the at least one storage unit; and wherein, when the retaining frame is moved from the first configuration to the second configuration, the at least one tab is bent towards a peripheral wall of the tubular body and away from the retaining surface of the at least one storage unit.

In the first configuration, a distance between the distal end of the tab and an opposite surface of the container may be at least as great as the stem diameter and less than the engagement diameter, and in the second configuration a distance between the distal end of the tab and an opposite surface of the container is at least as great as the engagement diameter.

This advantageously means that in the first configuration, the engagement portion of the at least one storage unit is not able to pass between the tab and the opposite surface of the container thereby retaining the at least one storage unit within the receptacle. Conversely, in the second configuration, the engagement portion is able to pass between the tab and the opposite surface of the container thereby allowing the at least one storage unit to be removed from the container.

Where the container comprises more than one tab, it may be the distance between two opposing tabs which, in the first configuration is at least as great as the stem diameter and less than engagement diameter, and in the second configuration is at least as great as the engagement diameter.

The storage unit may be sealed by a sealing tab, an area of a surface of the sealing tab being permanently affixed to a surface of the retaining frame or a surface of the tubular body such that, when the storage unit is removed from the container, the sealing tab is removed from the storage unit to reveal an opening of the storage unit to a user.

In a fifth aspect of the present invention, there is provided a kit comprising a container according to the fourth aspect of the present invention, and an elongate holder comprising a cavity for receiving the stem portion of the at least one storage unit, the cavity and the stem portion being configured for mutual locking engagement; wherein an outer diameter of the holder is at least substantially as great as the engagement diameter.

An internal transverse dimension of the tubular body may be at least 0.5 millimetres greater than the outer diameter of the holder.

As used herein, the term "transverse" relates to a direction perpendicular to the axis of the receptacle.

An internal transverse dimension of the tubular body may be less than 1.5 millimetres greater than the outer diameter of the holder.

An internal transverse dimension of the tubular body may be between about 0.5 millimetres and about 1.5 millimetres greater than the outer diameter of the holder. For example, the internal transverse dimension of the tubular body may be 1.0 millimetre greater than the outer diameter of the holder. This advantageously ensures that the holder is able to pass into the tubular body when the holder is used to remove a storage unit.

It should be appreciated that any feature in one aspect of the invention may be applied to other aspects of the invention, in any appropriate combination. Furthermore, any, some and/or all features in one aspect can be applied to any, some and/or all features in any other aspect, in any appropriate combination.

It should also be appreciated that particular combinations of the various features described and defined in any aspects of the invention can be implemented and/or supplied and/or used independently.

The invention will now be described in more detail by way of example only with reference to the accompanying drawings in which.

Figure 1:
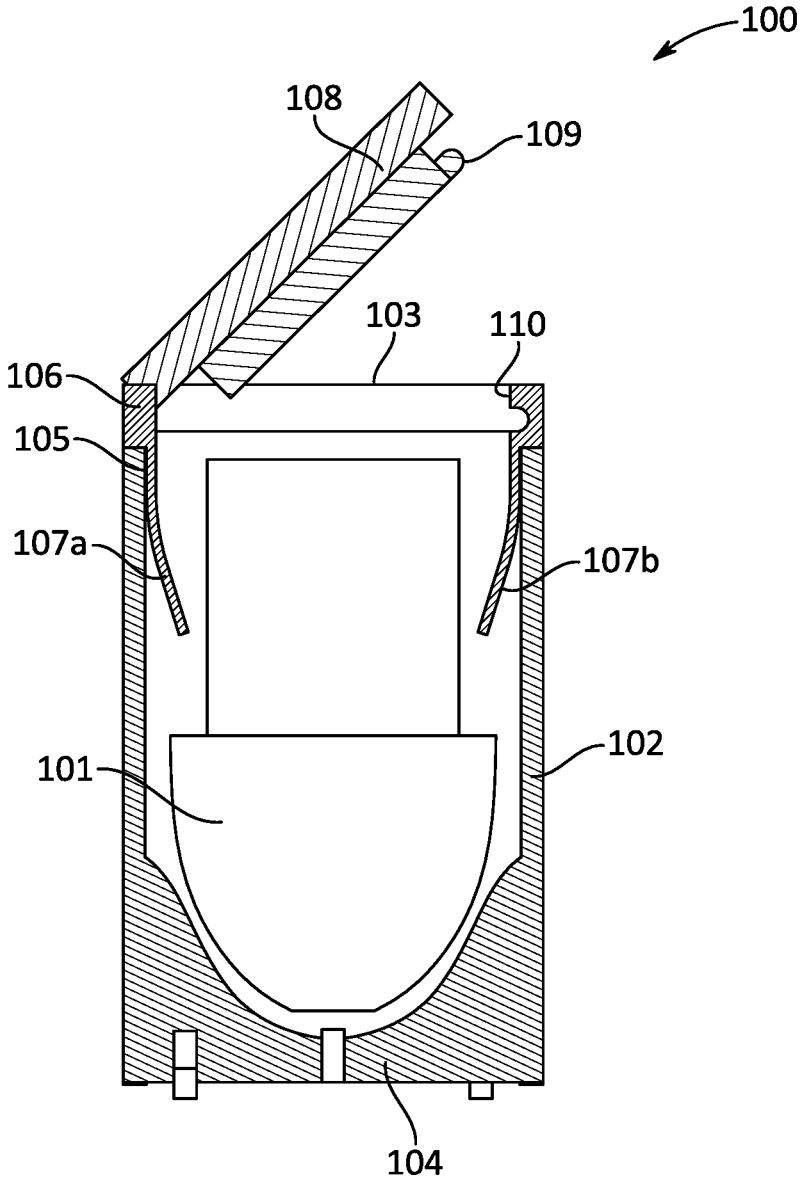
FIG. 1 is a cross-sectional side view of a container according to a first aspect of the present invention which is sized to accommodate a single storage unit.

FIG. 1 shows a container 100 with a storage unit 101 received within the container 100. The container 100 comprises a tubular body 102 which defines a receptacle. The tubular body 102 is sized to accommodate a single storage unit 101 and is formed from a polymer. The tubular body 102 has an open first end 103 and a closed second end 104. The container 100 further comprises a retaining frame 105 formed from a polymer. The retaining frame 105 comprises a supporting rim 106 which circumscribes the open first end 103 of the tubular body. The retaining frame 105 further comprises a pair of opposing tabs 107*a*, 107*b* depending from the supporting rim 106 and projecting radially from the rim 106 into the receptacle.

The container further comprises a lid 108 hinged to the open first end 103 of the tubular body 102. The lid 108 is integrally formed with the tubular body 102 and is attached to the tubular body 102 by a living hinge. The lid 108 is movable between a closed positon, where the lid 108 occludes the open first end 103 of the tubular body 102; and an open position, where the lid 108 is pivoted to reveal the open first end 103 of the tubular body 102. The lid 108 includes a projection 109 which, in the closed positon, engages with a corresponding recess 110 on the inner surface of the tubular body 102 to hold the lid 108 in the closed position.

The storage unit 101 comprises a stem portion, and an engagement portion defining a retaining surface. The stem and the engagement portion are axially aligned and the diameter of the engagement portion is greater than that of the stem portion.

In operation, before the storage unit 101 is used, the retaining frame 105 is in a first configuration where the tabs 107*a*, 107*b* engage with the stem of the storage unit 101 and the wider engagement portion prevents the storage unit 101 from passing out of the tubular body 102. To remove the storage unit 101, the retaining frame 105 is moved into the second configuration where the tabs 107*a*, 107*b* are bent such that their distal ends move towards a peripheral wall of the tubular body 102 and away from the stem of the storage unit 101. This increases the distance between the distal ends of the opposing tabs 107*a*, 107*b* such that the engagement portion is able to pass between them and out of the open first end 103 of the tubular body 101.

Figure 2:
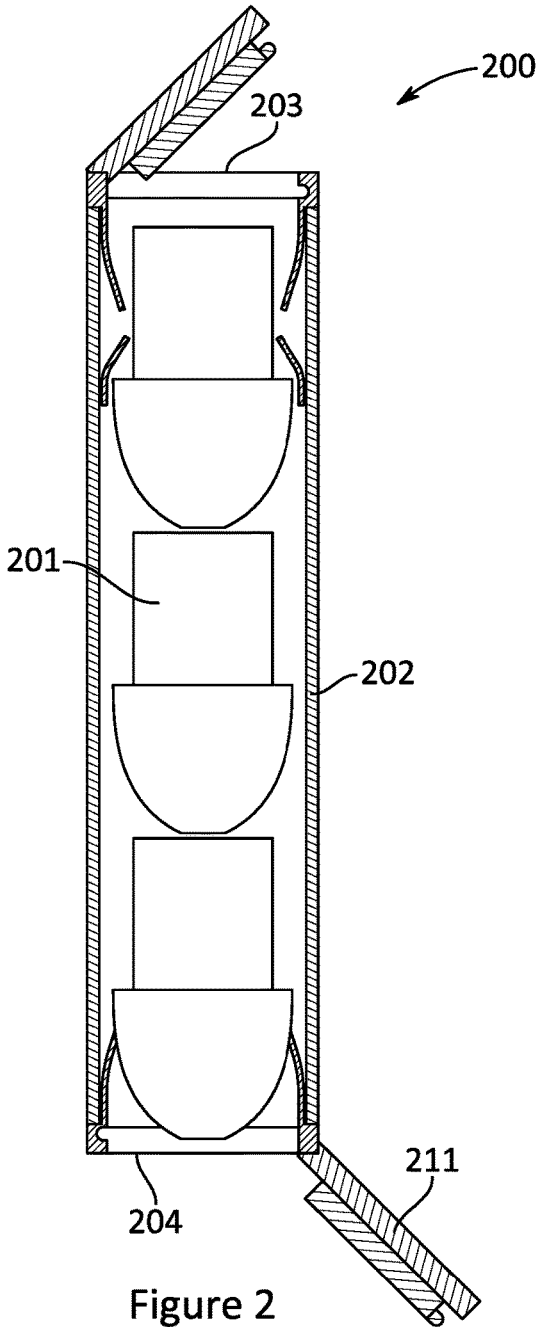
FIG. 2 is a cross-sectional side view of a container according to a first aspect of the present invention which is sized to accommodate a plurality of storage units.

FIG. 2 shows a further container 200. The container 200 is sized to accommodate three storage units 201 in axial alignment and includes an open second end 204 opposing the open first end 203. The open second end 204 is closed by a lid 211 hinged to the second end 204 of the tubular body 202. The lid 211 is movable between a closed position, wherein the lid 211 occludes the second end 204 of the tubular body 202; and an open position where, in which the lid 211 is pivoted to reveal the open second end 204 of the tubular body 202.

Figure 3:
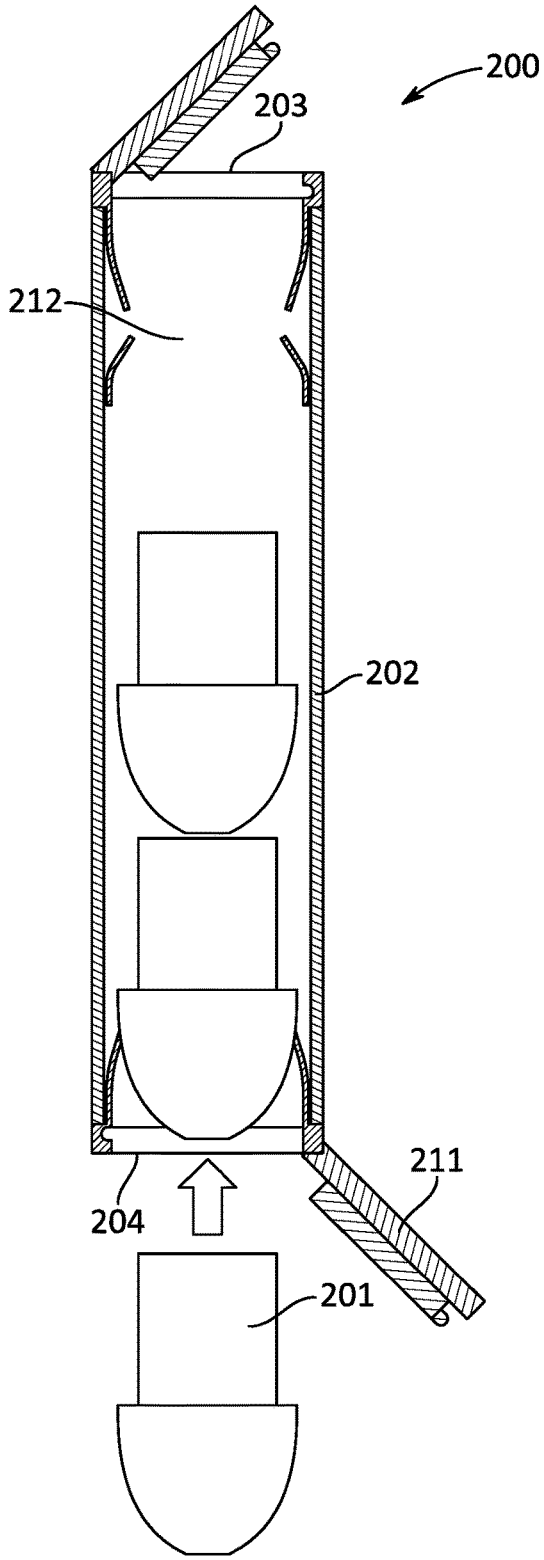
FIG. 3 is a cross-sectional side view of a container according to the present invention which is sized to accommodate a plurality of storage units which shows how a storage unit is inserted into the container.

FIG. 3 shows the operation of the container 200 of FIG. 2. A storage unit 201 has been removed from the open first end 203 of the tubular body 202 leaving a space 212. Once the storage unit 201 has been used, the lid 211 occluding the open second end 204 of the tubular body 202 is opened and the used storage unit 201 is inserted into the open second end 204. This pushes the remaining storage units towards the first end 203 of the tubular body 202.

Figure 4:
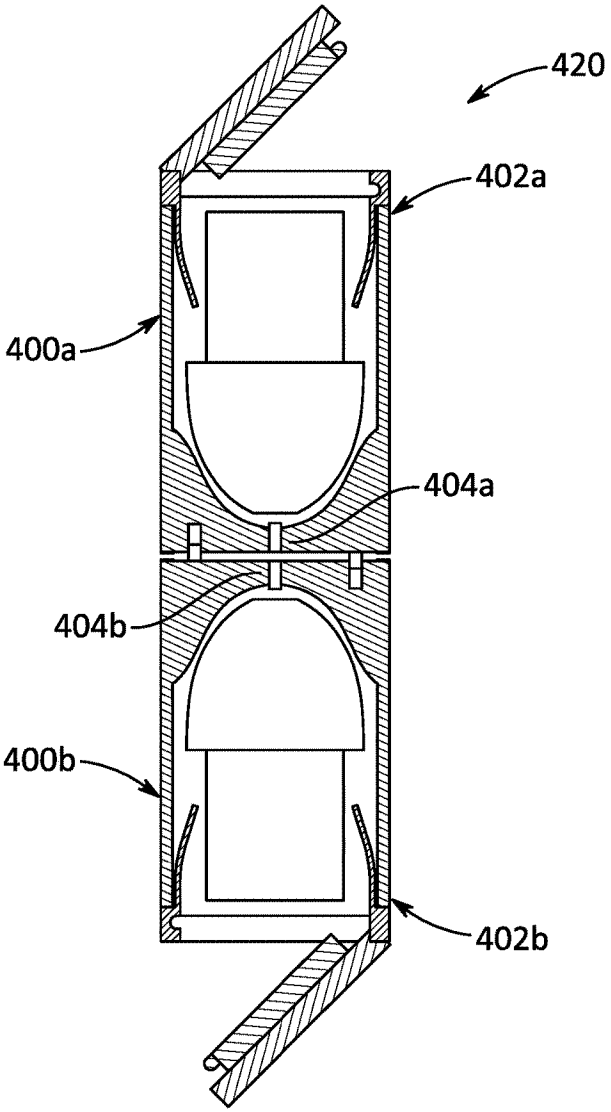
FIG. 4 is a cross-sectional side view of a container array according to a second aspect of the present invention.

FIG. 4 shows a container array 420. The array 420 comprises a first container 400*a* having a tubular body 402*a* having closed second end 404*a*, and a second container 400*b* having a tubular body 2*b* having a closed second end 404*b*. The closed second end 404*a* of the tubular body 402*a* of the first container 400*a* is connected to the closed second end 404*b* of the tubular body 402*a* of the second container 400*b* such that the first and second containers 400*a*, 400*b* are in axial alignment. The first and second containers 400*a*, 400*b* are connected along a line of weakness allowing them to be separated by a user. The first and second containers 400*a*, 400*b* are identical to each other and are each the same as the example shown in FIG. 1.

Figure 5:
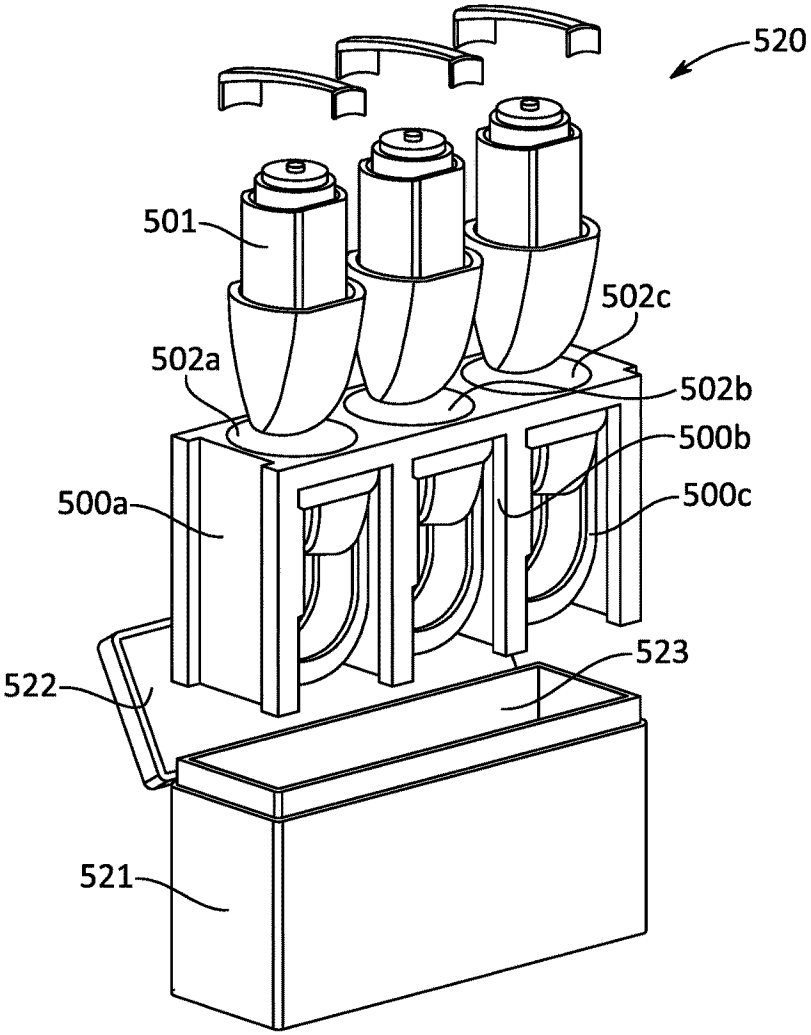
FIG. 5 is a perspective view of a container array according to a third aspect of the present invention.

FIG. 5 shows a further container array 520. The array 520 comprises a first 500*a*, second 500*b*, and third 500*c* container. Each of the first 500*a*, second 500*b*, and third 500*c* containers are identical to each other and are each generally the same as the container 100 shown in FIG. 1. Each of the first 500*a*, second 500*b*, and third 500*c* containers are sized to receive a single storage unit 501 meaning that the array 520 can accommodate three storage units in total. The first 500*a*, second 500*b*, and third 500*c* containers are arranged next to each other and are connected to and adjacent container or to adjacent containers along their respective tubular bodies 502*a*, 502*b*, 502*c*.

The container array 520 further comprises an outer housing 521 surrounding the three containers 500*a*, 500*b*, 500*c*. The outer housing 521 is formed from a laminar blank and included an integrally formed hinge lid 522 closing an opening 523. In use, the containers 500*a*, 500*b*, 500*c* are arranged within the outer housing 521 with the open first ends of the tubular bodies facing the same way as the opening 523 of the outer housing 521. The outer housing 521 is formed from cardboard.

Figure 6:
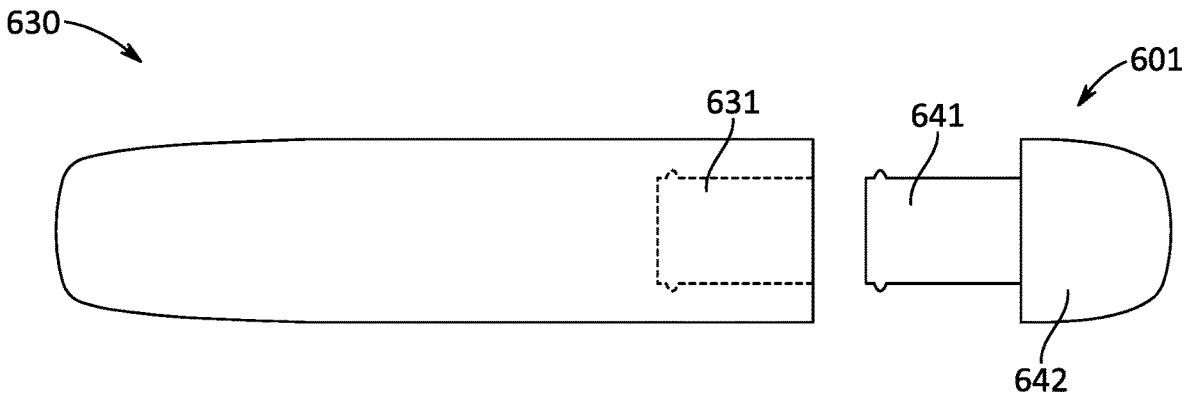
FIG. 6 is a side view of an elongate holder and storage unit for use with the container of the first aspect of the present invention.

FIG. 6 shows an elongate holder 630 and a storage unit 601. The elongate holder 630 is for removing a storage unit 601 from any of the containers described above. The storage unit 601 comprises a stem portion 641 having a stem diameter and an engagement portion 642 having an engagement diameter greater than the stem diameter. The engagement portion 642 defines the retaining surface of the storage unit 601 which engages with the supporting frame 105. Any of the containers described above may be provided as part of a kit further comprising an elongate holder 630. The holder 630 comprises a cavity 631 for receiving the stem portion 641 of a storage unit 601. The cavity 631 and the stem portion 641 are effectively configured for mutual releasable locking engagement, and an outer diameter of the holder 630 is at least substantially as great as the engagement diameter of the engagement portion 642.

Thus, the consumer may advantageously use the holder 630 to remove the storage unit 601 from a container. To this purpose, the consumer slides the holder 630 onto the storage unit 601 such that the stem portion 641 is received into the cavity 631 and the holder 630 and the storage unit 601 are in locking engagement. At the same time, the side wall circumscribing the cavity 631 pushes the tabs 107*a*, 107*b* of the retaining frame 105 from the first configuration to the second configuration. This releases the storage unit 101 from the retaining frame 105.

The invention claimed is:

1. A container, comprising:

a tubular body having an open first end and a second end to define a receptacle;

at least one elongate storage unit received within the receptacle; and a retaining frame disposed within the receptacle and configured to receive and retain the at least one storage unit, wherein the retaining frame is movable between a first configuration, wherein the retaining frame is configured to engage a retaining surface of the at least one storage unit to retain the at least one storage unit within the receptacle, and a second configuration, wherein the at least one storage unit is released from engagement with the retaining frame to be removed from the container, wherein the at least one storage unit comprises a stem portion having a stem diameter and an engagement portion having an engagement diameter greater than the stem diameter, the engagement portion defining the retaining surface of the configured storage unit, wherein the retaining frame comprises a supporting rim circumscribing the open first end of the tubular body, and at least one flexible tab depending from the supporting rim and projecting radially into the receptacle, such that in the first configuration a distal end of the at least one flexible tab is configured to engage the retaining surface of the at least one storage unit, wherein, when the retaining frame is moved from the first configuration to the second configuration, the at least one flexible tab is bent towards a peripheral wall of the tubular body and away from the retaining surface of the at least one storage unit, and wherein in the first configuration a distance between the distal end of the at least one flexible tab and an opposite surface of the container is at least as great as the stem diameter and less than the engagement diameter, and in the second configuration a distance between the distal end of the at least one flexible tab and the opposite surface of the container is at least as great as the engagement diameter.

2. A kit, comprising:

a container comprising:

a tubular body having an open first end and a second end to define a receptacle, at least one elongate storage unit received within the receptacle, and a retaining frame disposed within the receptacle and configured to receive and retain the at least one storage unit, wherein the retaining frame is movable between a first configuration, wherein the retaining frame is configured to engage a retaining surface of the at least one storage unit to retain the at least one storage unit within the receptacle, and a second configuration, wherein the at least one storage unit is released from engagement with the retaining frame to be removed from the container, wherein the at least one storage unit comprises a stem portion having a stem diameter and an engagement portion having an engagement diameter greater than the stem diameter, the engagement portion defining the retaining surface of the configured storage unit, and wherein the retaining frame comprises a supporting rim circumscribing the open first end of the tubular body, and at least one flexible tab depending from the supporting rim and projecting radially into the receptacle, such that in the first configuration a distal end of the at least one flexible tab is configured to engage the retaining surface of the at least one storage unit, wherein, when the retaining frame is moved from the first configuration to the second configuration, the at least one flexible tab is bent towards a peripheral wall of the tubular body and away from the retaining surface of the at least one storage unit; and an elongate holder comprising a cavity configured to receive the stem portion of the at least one elongate storage unit, the cavity and the stem portion being configured for mutual locking engagement, wherein an outer diameter of the elongate holder is at least substantially as great as the engagement diameter.

3. The kit according to claim 2, wherein an internal transverse dimension of the tubular body is between about 0.5 millimeters and about 1.5 millimeters greater than the outer diameter of the elongate holder.

* * * * *